US006295779B1

(12) United States Patent
Canfield

(10) Patent No.: US 6,295,779 B1
(45) Date of Patent: Oct. 2, 2001

(54) COMPOSITE FRAME MEMBER AND METHOD OF MAKING THE SAME

(76) Inventor: Fred C. Canfield, 20884 SE. Greenmont, Bend, OR (US) 97702

( * ) Notice: Subject to any disclaimer, the term of this patent is extended or adjusted under 35 U.S.C. 154(b) by 0 days.

(21) Appl. No.: 09/444,908

(22) Filed: Nov. 22, 1999

Related U.S. Application Data

(63) Continuation-in-part of application No. 08/978,851, filed on Nov. 26, 1997, now Pat. No. 5,987,843.

(51) Int. Cl.[7] ..... E06B 1/04; E06B 1/34

(52) U.S. Cl. ..... 52/656.4; 52/211; 52/716.8; 52/717.01; 52/717.05; 52/734.1; 52/738.1; 49/504

(58) Field of Search ..... 52/656.2, 656.4, 52/211, 212, 716.2, 716.8, 717.01, 717.02, 717.04, 717.05, 730.3, 734.1, 738.1; 49/504, 505, DIG. 2

(56) References Cited

U.S. PATENT DOCUMENTS

| | | | | |
|---|---|---|---|---|
| 2,586,102 | | 2/1952 | Smith . | |
| 3,082,490 | | 3/1963 | Loucks . | |
| 3,130,455 | | 4/1964 | Borlenghi . | |
| 3,345,780 | | 10/1967 | McGhee . | |
| 3,349,519 | | 10/1967 | Nehlig . | |
| 3,375,627 | | 4/1968 | Bursiek et al. . | |
| 3,393,471 | | 7/1968 | Skowlund et al. . | |
| 3,443,345 | | 5/1969 | Spencer . | |
| 3,591,985 | | 7/1971 | Coppins . | |
| 3,662,494 | | 5/1972 | Sitterly . | |
| 3,731,430 | * | 5/1973 | Dallaire et al. | 49/504 |
| 4,236,354 | | 12/1980 | Passovoy . | |
| 4,281,480 | | 8/1981 | Wendt . | |
| 4,439,965 | | 4/1984 | Langenhorst . | |
| 4,631,866 | * | 12/1986 | Otto et al. | 49/504 |
| 4,803,815 | | 2/1989 | Bürgers . | |
| 5,058,323 | | 10/1991 | Gerritsen . | |

(List continued on next page.)

FOREIGN PATENT DOCUMENTS

| | | | | |
|---|---|---|---|---|
| 476195 | * | 9/1969 | (CH) | 49/504 |
| 2260736 | * | 6/1974 | (DE) | 49/504 |
| 2557057 | * | 6/1977 | (DE) | 52/717.01 |
| 1475987 | * | 4/1967 | (FR) | 49/504 |
| 2197015 | * | 5/1988 | (GB) . | |
| 7510168 | * | 7/1976 | (NL) | 52/211 |
| 318389 | * | 12/1969 | (SE) | 52/738.1 |

OTHER PUBLICATIONS

English language abstract of United Kingdom Patent No. 2197015.
English language abstract of United Kingdom Patent No. 2276187.
English language abstract of German Patent No. 2809253.
Holm Industries Inc. advertisement entitled "Quietly Manufacturing the Best Weather–strip in the Industry".

*Primary Examiner*—Laura A. Callo
(74) *Attorney, Agent, or Firm*—Kolisch, Hartwell, Dickinson, McCormack & Heuser, PC

(57) ABSTRACT

A composite frame member and a method for making the same. In one embodiment, the frame member is a door frame including a plurality of framing members, each including a core formed from a foamed or cellulosic material that includes a wall surface adapted to be mounted within a cavity formed in the wall of the house or other building with which the frame is to be used, and a door surface is opposed to the wall surface and is adapted to extend within the cavity. The core preferably includes an elongate base member and an elongate stop member mounted on the base member in a parallel relationship to the base member. Each framing member further includes a resilient shell, which is preferably formed from a waterproof material, and which, in some embodiments, may be snap-fit on the core. A brickmold member is also disclosed, as well as various methods for making the invented frame and brickmold members.

34 Claims, 5 Drawing Sheets

U.S. PATENT DOCUMENTS

| | | | | |
|---|---|---|---|---|
| 5,203,130 | | 4/1993 | Freelove . | |
| 5,222,345 | * | 6/1993 | Riley | 52/717.01 |
| 5,249,399 | | 10/1993 | Aulson . | |
| 5,293,723 | | 3/1994 | Slessor . | |
| 5,326,187 | * | 7/1994 | St. Marie et al. | 52/717.05 X |
| 5,347,780 | | 9/1994 | Richards et al. . | |
| 5,546,715 | | 8/1996 | Edstrom . | |
| 5,613,324 | | 3/1997 | Theune . | |
| 5,634,303 | | 6/1997 | Ellingson . | |
| 5,651,223 | * | 7/1997 | Novak et al. | 52/211 |
| 5,669,192 | | 9/1997 | Opdyke et al. . | |
| 5,758,458 | | 6/1998 | Ridge . | |
| 5,836,118 | | 11/1998 | Thornton et al. . | |
| 5,901,510 | * | 5/1999 | Ellingson | 52/211 X |
| 5,987,843 | | 11/1999 | Canfield . | |
| 6,112,481 | * | 9/2000 | Schiedegger et al. | 52/211 |
| 6,125,605 | * | 10/2000 | Young | 52/717.01 |

* cited by examiner 40
36
40
30
34
40
32
3
3
38

COMPOSITE FRAME MEMBER AND METHOD OF MAKING THE SAME

CROSS REFERENCE TO RELATED APPLICATION

This application is a continuation-in-part of and claims priority to U.S. patent application Ser. No. 08/978,851 of Fred C. Canfield, filed Nov. 26, 1997, now U.S. Pat. No. 5,987,843 the disclosure of which is hereby incorporated by reference.

FIELD OF THE INVENTION

The present invention relates generally to frame members, and more to a maintenance free composite frame member that includes a structural shell with an underlying core and does not require the extensive shaping, molding and waste of conventional wooden frames, such as may be used on doors and windows, and especially on exterior door frames.

BACKGROUND AND SUMMARY OF THE INVENTION

Conventional door frames, especially exterior door frames, are formed from lumber, such as ponderosa pine. These frames have been the industry standard for years, however, as discussed below, require time-, labor- and waste-intensive steps when compared to the invented composite door frame described herein. Furthermore, conventional frames have inherent weaknesses and security concerns on account of their materials of construction.

By way of background, it should be understood that door frames have four principle components. The first two are a pair of elongate jambs, which extend vertically in a side-by-side, opposed relationship to each other to define the side walls of a cavity into which a door is hung. The other two are a header that spans the distance between the upper regions of the jambs to connect the jambs and define the top wall of the cavity, and a sill that spans the distance between the lower regions of the jambs to define the bottom wall of the cavity. Typically, the jambs and header have the same, or substantially the same, cross-sectional configuration. The sill usually is inclined as it extends inwardly from the exterior of the wall within which the frame is installed. A door is "hung" or mounted, via hinges, on one jamb, and includes a lock or clasp that engages a corresponding socket on the other jamb. As used herein, the jamb on which the door is mounted is referred to as the door-side jamb, and the jamb that is engaged by the door's lock or clasp is referred to as the lock-side jamb.

The header and jambs of a conventional frame typically have the cross-sectional configuration shown in FIG. 1. A portion of a jamb is indicated generally at 10 in FIG. 1. As discussed, however, the header and jambs typically have the same cross-sectional configuration. Jamb 10 includes a base member 12 that is mounted within an opening in a wall of the building, house or other structure. Base member 12 includes a lower surface 14 that is mounted against the portion of the wall that defines the opening, and exterior and interior surfaces 16 and 18, respectively, that face in the direction of the corresponding exterior and interior surfaces of the wall. As discussed, base member 12 is formed from lumber through a process described subsequently. Member 12 includes a stop region 20, which selectively engages the door and defines the forward limit to which the door may pivot in the direction of the exterior of the wall. Member 12 also defines a rabbetted or removed region 22 through which the door passes before and while in engagement with stop region 20.

Each jamb typically includes some form of weather stripping 24 that is secured to stop region 20. In FIG. 1, weather stripping 24 is inserted within a channel 26 carved within stop region 20. The jambs and header may also include brickmold, which is mounted on exterior surface 16 and extends laterally beyond the frame to overlap a portion of the exterior surface of the wall forming the opening for the frame. As shown in the portion of the lock-side jamb shown in FIG. 1, the jamb typically includes at least to one socket with which portions of the door's lock are inserted to prevent selectively the door from being opened. As shown, jamb portion 10 includes a pair of sockets 28 and 29, which are configured to receive bolts from a standard door lock and a deadbolt lock.

While this configuration has been the industry standard for years and seems safe enough, it offers only minimal security to a determined intruder. The principle reason for this lack of security is due to the lumber which is used to form the conventional exterior door frame. Because sockets 28 and 29 are mounted a standardized distance away from stop member 20, there is only a narrow portion of base member 12 between the sockets and interior surface 18 of the jamb. Furthermore, because the grain of the lumber extends generally along the length of the jamb, the jamb is prone to splitting or shattering in the direction of the grain. These combined factors contribute to a frame which may be relatively easily broken or split by forcing, and most commonly kicking, the door inwardly in the general vicinity of where the lock engages the jamb's sockets.

Another problem with conventional exterior door frames is the way even treated lumber deteriorates when exposed to rain, extreme temperatures, snow, insects, etc., over a prolonged period of time. Wood exterior frames tend to splinter and chip over time, as well as when bumped or otherwise struck during use. Furthermore, when lumber gets wet, it expands. Therefore, conventional frames tend to deform and expand into the opening when water penetrates the weather-treating, if any, on the frame. Furthermore, once water contacts any portion of the lumber, it wicks along the wood to to contact and thereby deform or begin deteriorating adjacent regions. Attempts have been made to wrap portions of the frames with a thin, paper-like layer of weather resistant material, but this has not proven to be a sufficient remedy for this problem over time. While this wrapping or capping process may extend the life of the frame, it still requires the time and labor-intensive process to form the underlying lumber construction, and furthermore lacks sufficient strength and structure to protect and support the rest of the fame. Therefore, there remains a need to protect a conventional frame from the elements, as well as from being struck by individuals or other objects.

An additional problem with conventional frames is the significant time-, labor- and waste-intensive steps needed to manufacture the frame. As an initial step, a tree is chopped down, delimbed, debarked and cut into elongate strips of lumber. During this initial step, approximately twenty-five percent, or more, of the original wood is wasted. The produced lumber predominately is what is referred to as "shop-grade" lumber, in that it is rough and contains knots and other irregularities. Therefore, the next step is to cut out the knots and other irregular areas from the lumber and then fingerjoint the remaining pieces back together. At this point, the lumber is in elongate lengths that are substantially free or "clear" of knots and other defects.

The lumber is next fed through a molder, which shapes the lumber into the cross-sectional configuration shown in FIG. 1. At this point, approximately forty or more percent of the remaining wood has been discarded or otherwise removed from the original lengths of lumber. Next, notches 26 are carved into the stop regions of the strips, the strips are cut to length and the ends are notched with a double end tenoner so that the jambs and header will smoothly mate with each other. The lengths of molded lumber are subsequently primed, so that they may be later painted, and weathertreated, to slow the deterioration of the frame from exposure to rain, snow and other elements. Finally, the frame is assembled, weather stripping is secured to the jambs, sockets are drilled in one jamb to receive portions of a lock, and a door is hung on the other jamb.

This process is not only slow and labor-intensive, but as discussed above, also is extremely wasteful, raising environmental as well as other cost and efficiency concerns. Although a number of exterior door frames are known in the prior art such frames are unsatisfactory due to their failure to address and satisfy all of the concerns listed above.

The present invention overcomes these problems by providing a composite exterior frame member, such as may be used to form door and window frames. Each member includes a core formed from a foamed or cellulosic material that includes a wall surface adapted to be mounted within a cavity formed in the wall of the house or other building with which the frame is to be used, and a door surface is opposed to the wall surface and is adapted to extend within the cavity. The core preferably includes an elongate base member and an elongate stop member mounted on the base member in a parallel relationship to the base member. Each framing member further includes a resilient shell, which is preferably formed from a waterproof material, and which may be snap-fit on the core. The shell forms a continuous waterproof expanse which generally conforms to the shape and configuration of the core to cover and protect the door surface of the core and the lateral edges extending between the core's wall surface and the door surface. The shell may further include weather stripping that is formed with the shell in a one-piece unit, and the framing members may further include conventional or invented brickmold attached thereto.

These and other features of the invention will become more fully apparent as the detailed description below is read with reference to the accompanying drawings.

DETAILED DESCRIPTION OF THE PREFERRED EMBODIMENTS AND METHOD OF MAKING THE SAME

Figure 2:
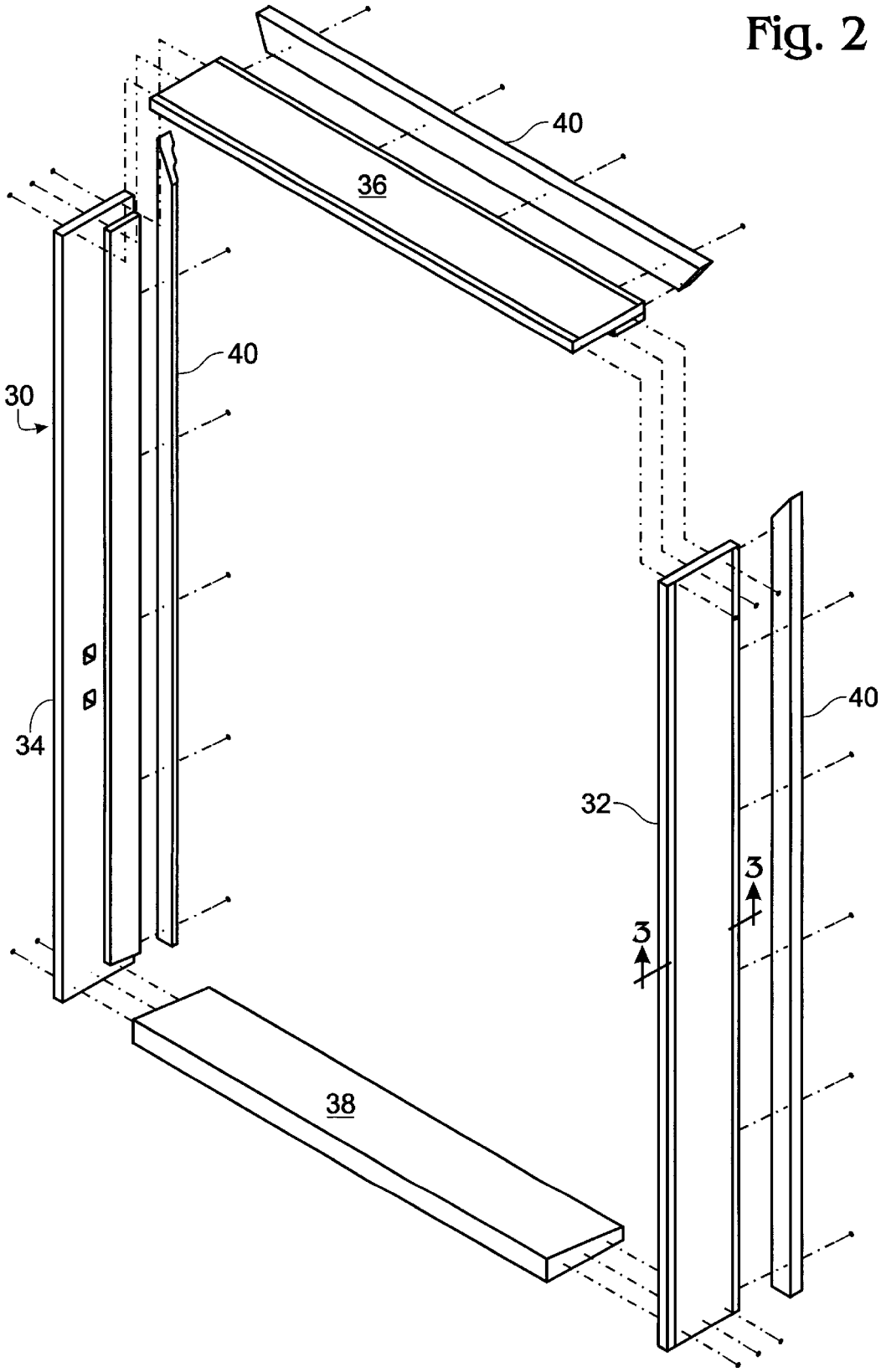
FIG. 2 is an isometric, partially exploded view of an exterior door frame constructed according to a preferred embodiment of the present invention.

A preferred embodiment of the invented exterior door frame is shown in FIG. 2 and indicated generally at 30. As shown, frame 30 includes a door-side jamb 32, a lock-side jamb 34, a header 36 extending between and connecting the upper portions of the jambs, and a sill 38 extending between and connecting the lower portions of the jambs. As shown in FIG. 2, brickmold 40 is mounted on the jambs and header, although it should be understood that the frame may be constructed with or without brickmold. Similarly, it should be understood that frame 30 is conventionally packaged and sold as a unit with a door hung on the frame. As used herein, the frame's jambs 32 and 34 and header 36 are collectively referred to as framing members, and each have the same cross-sectional configuration and component parts. Sill 38, on the other hand, will tend to have a different cross-sectional configuration and may extend at an angle with respect to the frame, as shown in FIG. 2. It should be understood that frame 30 may be sold or built without sill 38, with the sill added subsequently if desired by a user.

Frame 30 is configured to be mounted within a doorway or cavity defined in an exterior wall of a structure, such as a house, building, garage, etc. The wall has outside and inside surfaces, which respectively face the outside environment and the interior working or living space of the structure. The above recited outside and inside edges and surfaces are named as such to provide reference terms consistent with the configuration in which exterior doors are conventionally mounted, namely so that a hung door opens inwardly into the building or other structure in which the frame is installed. It should be understood that frame 30 could be installed so that the door opens outwardly, in which case the structure of frame 30 would remain the same, except the terms outside and inside will be reversed from the context in which they are used herein.

Furthermore, the doorway is bounded on at least its lateral and upper extents by the wall's studs, which are typically two-by-fours or two-by-sixes. Therefore, it should be understood that frame 30 may vary in dimensions, depending upon the depth or thickness of the wall and size of the cavity or doorway. Examples of standardized widths for the framing members are 4 ⅛ inches for a stucco or similar house, 4 9/16 inches for a two-by-four framed house, and 6 9/16 inches for a two-by-six framed house. Similarly, jambs 32 and 34 are typically approximately seven feet long (usually eighty-one and one half inches), and header 36 is typically thirty, thirty-two or thirty-six inches long.

Figure 1:
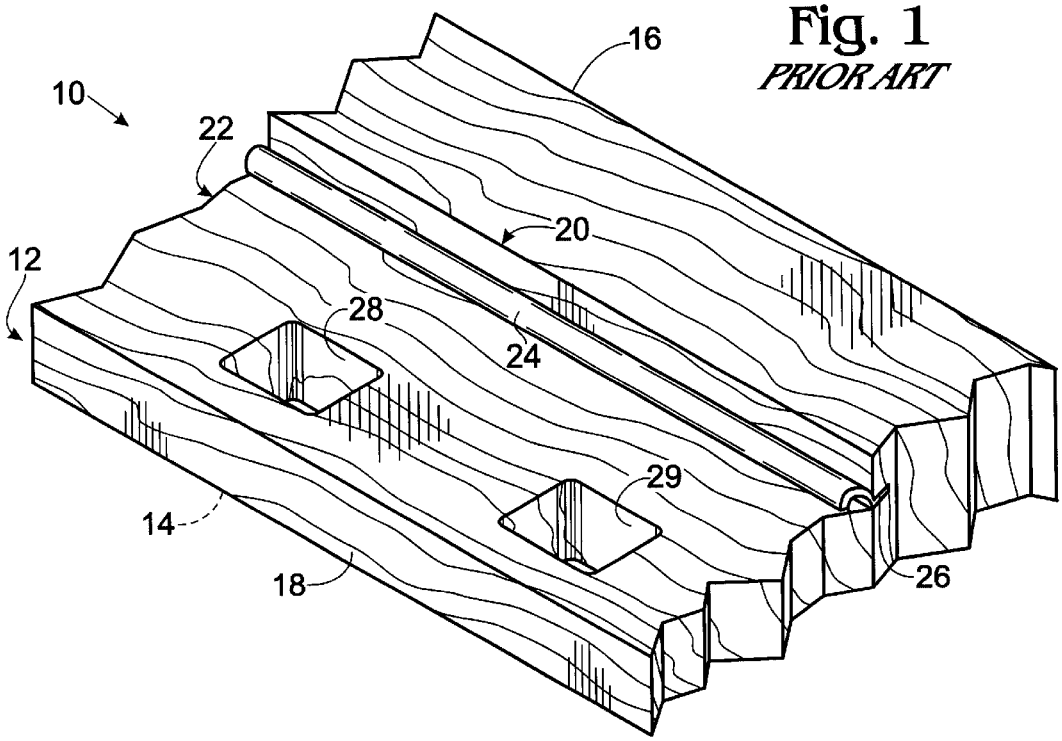
Fig. 1 PRIOR ART
FIG. 1 is an isometric, sectional view of a portion of a conventional exterior door frame.
Figure 3:
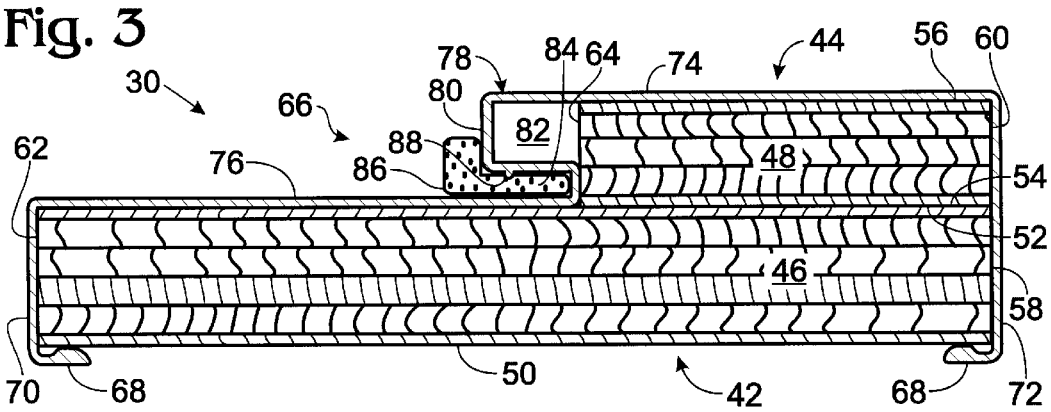
FIG. 3 is a cross-sectional view of a portion of the frame of FIG. 2, taken along the line 3—3 in FIG. 2.

In FIG. 3, the cross-sectional configuration of the framing members is shown in more detail. As shown, each filming member includes a core, which is generally indicated at 42, and a shell, or cladding, which is generally indicated at 44. Core 42 and shell 44 collectively provide an exterior door frame that overcomes the problems and safety concerns inherent in conventional exterior door designs, as discussed below. The framing members provide a secure, maintenance-free exterior door frame that may be manufactured significantly easier and quicker than conventional firms, while providing increased security, durability and strength.

As shown in FIG. 3, core 42 is formed from two discrete members, namely a base member 46, with a first cross-sectional area, and a stop member 48, with a second cross-sectional area that is less than the cross-sectional area of the base member. Members 46 and 48 each have respective wall surfaces 50 and 52 that are mounted on the structural members, or studs, defining the cavity within which the frame is installed, and door surfaces 54 and 56 that are generally opposed to the corresponding wall surfaces and face the cavity into which the door is hung. Members 46 and 48 further include respective outside edges 58 and 60 that extend between the wall surfaces and door surfaces and are generally aligned with the outside surface of the wall on which frame 30 is mounted, and inside edges 62 and 64 that extend between the wall surfaces and door surfaces and are generally aligned with the inside surface of the wall on which frame 30 is mounted. Surfaces 50–56 and edges 58–64 collectively form the generally rectangular cross-sectional configurations of members 46 and 48 that are shown in FIG. 3. The cross-sectional area of stop member 48 is generally within the range of approximately five percent to approximately sixty percent of the corresponding cross-sectional area of base member 46, preferably within the range of approximately ten percent to approximately fifty percent, more preferably within the range of approximately fifteen percent to approximately forty percent, and even more preferably within the range of approximately fifteen percent to approximately thirty percent.

As shown, outside edges 58 and 60 of base member 46 and stop member 48 are aligned, and wall surface 52 of stop member 48 is mounted on door surface 54 of base member 46 to give core 42 a stair-step of L-shaped configuration. The members are secured together with a suitable fastener, such as adhesives, staples, screws, nails, etc. Staples are currently preferred because they are extremely inexpensive and provide a secure bond between the members without requiring the drying time and expense of an adhesive fastener. The inside edge of stop member 48 and the portion of door surface 54 to that is not covered by the stop member collectively form what is herein referred to as a door-receiving notch, which is indicated generally at 66 in FIG. 3.

In FIG. 3, base member 46 and stop member 48 of core 42 are formed from plywood, which has proven to be especially well-suited for use in the present invention because of its relatively inexpensive cost, as compared to lumber and other wood-products, as well as its increased strength in all planes, as compared to lumber which tends to split or break along its grain. Therefore, the previously discussed weakness, or susceptibility, of conventional lumber frames being kicked in is removed because of the added strength of plywood. It is intended to be within the scope of the present invention, however, that core 42 may be formed from other cellulosic materials, such as OSB (strandboard), MDF (fiberboard), particle board, etc., as well as metal and other composite materials. Core 42 also may be formed from a foamed material, such as a polystyrene-based material, such as a dense styrofoam. The essential requirement on such a foamed material is that it is capable of retaining screws, which are used to hang a door on the frame, and that it is capable of supporting the weight and forces exerted upon the door once it is hung on the frame. Additionally, the material should also be able to receive and retain screws or other fasteners used to mount a screen or storm door on the frame, and to withstand the combined weight and forces of having a pair of doors mounted on the frame.

Shell 44 is sized to correspond closely to the cross-sectional configuration of core 42 and, as shown in FIG. 3, covers a substantial portion of the door surfaces, to outside and inside edges 54–64 of the core. Shell 44 provides a maintenance-free, waterproof cladding that protects core 42. It should be understood that shell 44 is not merely a thin layer applied to core 42 to increase the weather resistance of the core. Instead, the shell is a durable structural member, capable of retaining its configuration and standing alone apart from the core. Shell 44 not only protects core 42 from damage caused by environmental factors, such as rain, wind, ice and snow, but also protects core 42 from physical damage as well.

As shown, shell 44 extends from wall surface 50 of base member 46, across outside surfaces 58 and 60 of the base and stop members, across door surface 56 of stop member 48, covers door-receiving notch 66, and returns to wall surface 50 of base member 46 by covering the base member's inside surface 62. Furthermore, adjacent each end of wall surface 50, shell 44 includes a flange-like member, or foot, 68 that retains the shell on core 42. Feet 68 enable shell 44 to be snap-fit on core 42, and thereby retained on the core without the addition of adhesives or fasteners. (In many applications, however, it is preferable to also secure shell 44 on core 42 with an adhesive, which may be applied to the core, the shell, or both, prior to snap-fitting the shell on the core.)

For sake of discussion, the component regions of shell 44 may be referred to as first and second lateral regions 70 and 72, which respectively engage and cover inside edge 62 of base member 46 and outside edges 58 and 60 of the base and stop members. As shown, the shells' feet 68 each extend from a respective one of the lateral regions toward the other lateral region. Shell 44 further includes first and second planar regions 74 and 76 that respectively cover and engage door surface 56 of stop member 48 and at least a substantial portion of the door surface 54 of base member 46 which is not covered by the stop member.

As shown, shell 44 engages and contacts the adjacent surfaces of core 42 along its length, with the exception of a shelf, which is indicated generally at 78 in FIG. 3. Shelf 78 projects away from first planar region 74 into door-receiving notch 66, where it defines a stop edge 80, which extends generally parallel to inside edge 64 of the stop member. As shown, stop edge 80 is spaced apart from stop member 48 and defines a cavity or passage 82 between the shelf and inside edge 64 of the stop member. Shelf 78 generally extends at least approximately one-fourth inch into the door-receiving notch, and preferably approximately one half inch into the notch.

Shelf 78 further defines a channel 84 along its length between the shelf and second planar region 76, into which weather stripping 86 is inserted to cushion the engagement of a door and shelf 78, as well as to prevent air, dirt and other materials from passing between the inside of the house and the outside environment. Weather stripping 86 may take a variety of forms, including plastic or vinyl materials, cloth, foamed rubber or other materials, etc. When a metallic door, or a door with metal edges, is hung on frame 30, magnetic weather stripping may be desirable. Furthermore, shelf 78 preferably includes at least one tooth 88 that extends from shelf 78 into channel 84 to retain weather stripping 86 within the channel. Because the teeth are formed with shell 44 as a one-piece unit, it should be understood that a pair of spaced-apart teeth may be used to provide increased protection against weather stripping 86 being unintentionally removed from the framing members. When magnetic weather stripping is used, it is desirable to use at least two teeth because of the magnetic attraction between the door and the weather stripping. While tooth or teeth 88 may be sufficient to retain the weather stripping within channel 84, an additional adhesive or fastener may be used as well.

Figure 4:
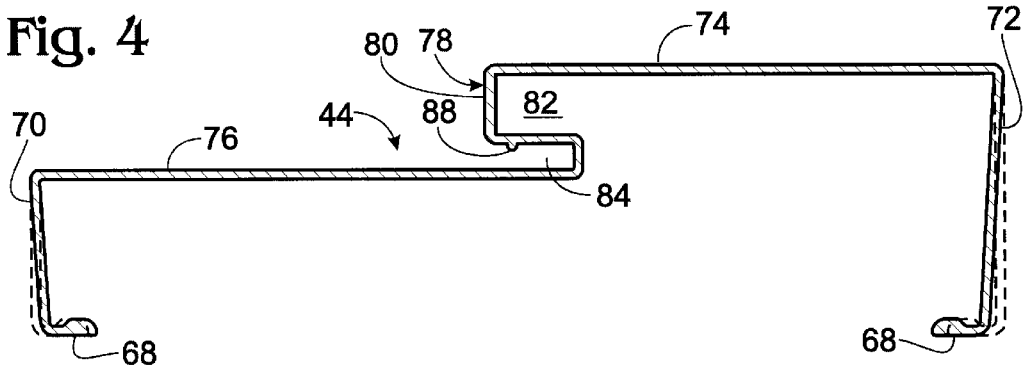
FIG. 4 is a cross-sectional view of the shell of the frame shown in FIG. 3.

As shown in FIG. 4, the lateral regions 70 and 72 of shell 44 are biased to extend slightly inwardly toward each other as they extend away from the door surfaces of the base and stop members. Each lateral region extends at an angle in the range of approximately 70° and approximately 90°, and preferably within the range of 80° and 90°, with respect to the door surface to which it is connected. As shown, each lateral region extends at an angle of approximately 86°. Once snap-fit onto core 42, the lateral regions and their corresponding feet 68 grip core 42 and secure the shell thereon. As such, shell 44 is retained in its mounted position on core 42 and constrained from unintentional removal, especially after the framing members are united to form the finished frame and after the finished frame is installed within an opening in a wall.

Figure 5:
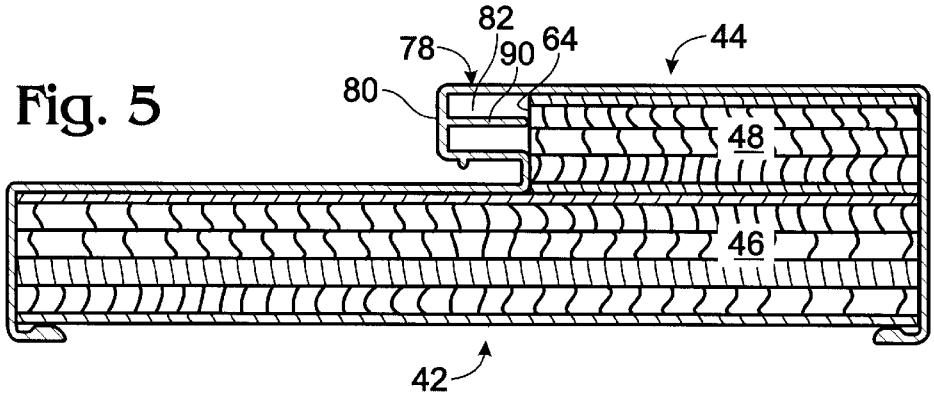
FIG. 5 is a cross-sectional view of another embodiment of the frame of FIG. 2.

In FIG. 5, an alternate embodiment of shell 44 is shown. In this embodiment, shelf 78 includes a rib 90 that extends from stop edge 80 within passage 82 to engage inside edge 64 of stop member 48. Rib 90 reinforces and provides additional support to shelf 78, which is especially useful when the door is slammed or otherwise forced into a closed position, or when frame 30 is used in especially cold climates, where shell 44 may be less flexible and resilient than in normal operating environments.

Figure 6:
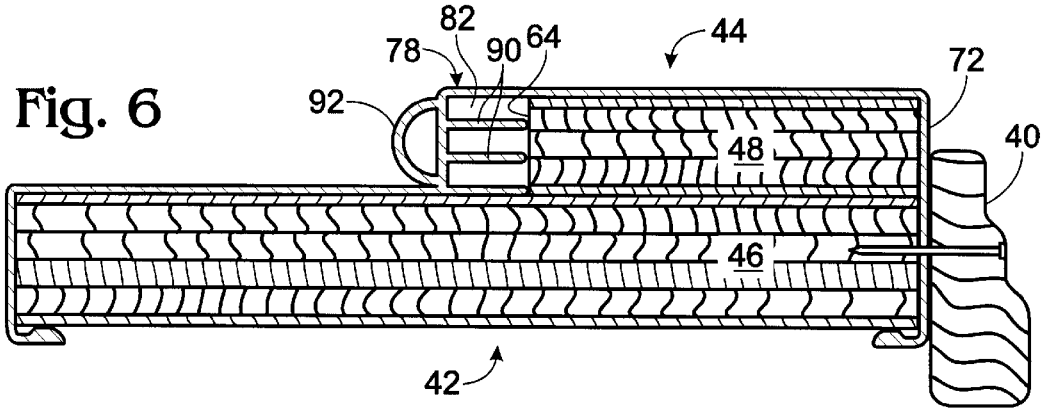
FIG. 6 is a cross-sectional view of another embodiment of the frame of FIG. 2 with attached brickmold.
Figure 10:
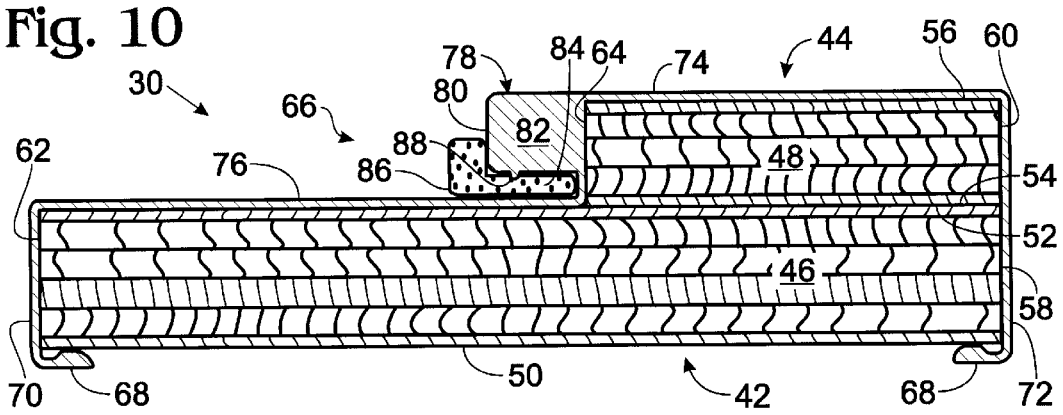
FIG. 10 is a cross-sectional view of another embodiment of the frame of FIG. 3.
Figure 11:
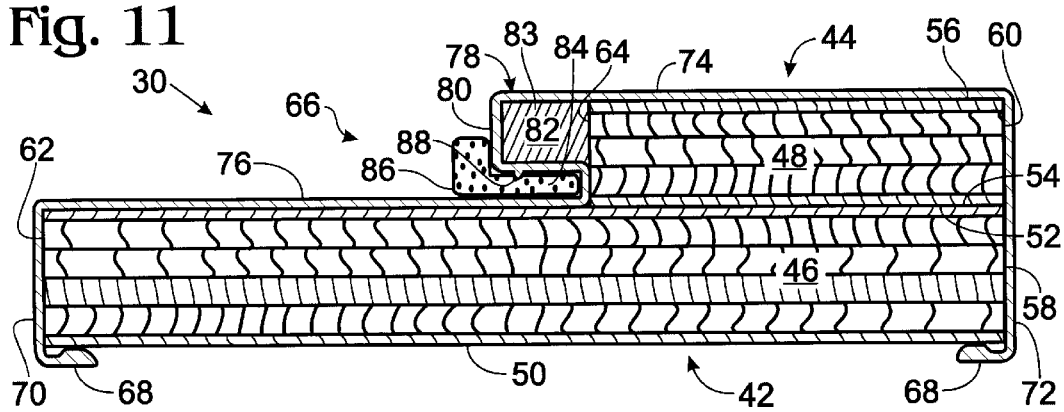
FIG. 11 is a cross-sectional view of another embodiment of the frame of FIG. 3.

It is intended to be within the scope of the present invention that shell 44, and particularly shelf 78, could include a plurality of ribs or other supports within cavity 82, such as shown in FIG. 6, or even that cavity 82 could be entirely filled by shelf 78, such as shown in FIG. 10. In addition to the ribs discussed above, cavity 82 may be filled with a material other than the material used to form shell 44. For example, as shown in FIG. 11, cavity 82 is filled with a suitable filler 83, such as an insulating or reinforcing material. Examples of suitable fillers include cellular PVC, foamed materials such as styrofoam, and any other suitable extrudable or injectable material may be used. In the embodiments of shell 44 that include one or more ribs within cavity 82, a portion or all of the remaining portion of the cavity may also be filled with filler 83.

A further embodiment of shell 44 is shown in FIG. 6. In this embodiment shell 44 includes weather stripping 92 that is integrally formed with shell 44. By integrally formed, it is meant that weather stripping 92 is formed with the shell as a one-piece unit, such as in the same extrusion or manufacturing process as the rest of shell 44. Although it comprises a portion of the unitary shell shown in FIG. 6, weather stripping 92 should be much more pliable and flexible than the rest of shell 44 so that it can conform to the shape of the door and form a tight seal between the door and the frame.

As shown, shelf 78 still defines a passage 82 between the shelf and the inside edge of the stop member, however, the necessity of forming a channel for receiving weather stripping is eliminated because weather stripping 92 is integrally formed with shell 44. An advantage of this embodiment is that the manufacturing costs and time are reduced because the weather stripping is formed as the rest of shell 44 is formed, and therefore the weather stripping does not need to be obtained from an outside source, or manufactured in a separate step, and subsequently added and secured (usually by hand) to the shell. It should be understood that the integrally formed weather stripping described above could be included with any of the embodiments of shell 44 described herein.

Shell 44 is formed from a water-resistant, and preferably waterproof, material that will maintain its appearance and strength over a prolonged period of time. Shell 44 should be able to be stained, painted or otherwise able to be colored, such as by tinting or dying the materials prior to extruding, roll-forming or otherwise shaping it into the one of the configurations described herein. The material used to form shell 44 should not flake, crack or deform when exposed to severe weather conditions. Vinyl and vinyl-based materials have proven to be particularly well-suited as appropriate materials of construction for shell 44. An example of such a material is RIGID GEON® vinyl, which is manufactured by the Geon Vinyl Division of The BF Goodrich Company of Cleveland, Ohio. An added advantage of a rigid vinyl material is its natural flame retardance, a particularly desirable characteristic of a material for use in a house or other dwelling, and its resistance to chemicals, such as acids, bases, salts and nonaromatic hydrocarbons.

It should be understood that other materials meeting the above-specifications may be used as well and are intended to be within the scope of the present invention. For example, composite and metal materials may be used as well, as long as they meet the requirements set forth above. Examples of suitable metals are aluminum and steel. An example of a suitable composite material is sold by THE BF Goodrich Company under the brand name FIBERLOCK®. An advantage of the FIBERLOCK® material is that its coefficient of expansion is approximately one half that of RIGID GEON® vinyl, thereby eliminating the requirement of using an adhesive to bond shell 44 to core 42. While an adhesive may still be used to secure shell 44 to core 42, fasteners, such as nails and staples, have proven to be suitable as well. When the coefficient of expansion of the shell and the core materials are approximately the same, simply snap-fitting the shell on the core has proven to be sufficient. Furthermore, simply snap-fitting the shell on the core, or using an adhesive is preferable over using staples or other fasteners which introduce holes to the shell, thereby providing an opening through which water and other materials, insects, etc. can eventually gain access to the core of the framing members.

Also shown in FIG. 6 is brickmold 40, which is secured with nails or another suitable fastener to the outside edge of the framing members. Brickmold 40 is used to enhance the appearance of frame 30, as well as to provide a cover or region of overlap between the outside edge of the framing members and the outside surface of the wall on which the frame is installed. The shape and configuration of brickmold 40, as well as its materials of construction, vary from fairly simple geometric structures, to very ornate structures. Regardless, the principle structural purpose of the brickmold is to cover, from the outside of the house or other structure, the area where the framing members are mounted on the wall.

Figure 7:
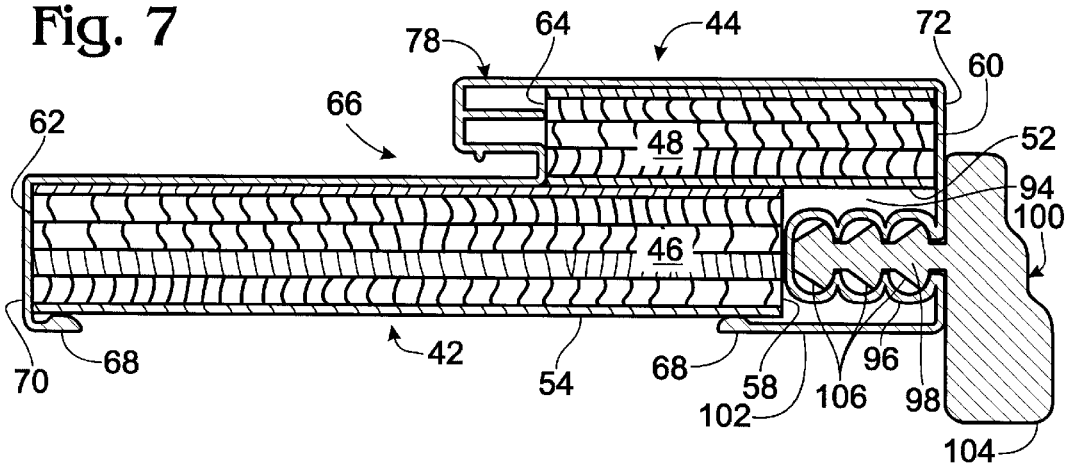
FIG. 7 is a cross-sectional view of another embodiment of the frame of FIG. 2, with attached brickmold constructed according to another preferred embodiment of the invention.

A further embodiment of the invention is shown in FIG. 7. As with all prior embodiments, the component parts and reference numerals remain the same unless otherwise specified. In this embodiment, base member 46 of core 42 is shorter than in prior embodiments, with outside edge 58 of base member 46 disposed generally between the inside and outside edges 60 and 64 of stop member 48 to define a removed region 94 bounded on two sides by outside edge 58 of base member 46 and the portion of the stop member's wall surface 52 that is not in direct contact with base member 46. Furthermore, shell 44 includes a receiver 96, which is adapted to receive a male portion 98 of an invented type of brickmold 100. Because base member 46 is off-set with respect to stop member 48, lateral region 72 of shell 44 includes a spacer 102 extending between the lateral region and foot 68, so that the foot still engages the wall surface of base member 46 to "snap-fit" shell 44 on core 42.

Brickmold 100 includes a body region 104, which may take the shape of any conventional brickmold, such as is shown in FIG. 6. Unlike conventional brickmold, however, brickmold 100 includes male portion 98, which extends from body region 104 to be inserted within receptacle 96 in shell 44. Male portion 98 is a prong-like member, which preferably includes a plurality of projections 106 that sequentially engage segments of receiver 96 to increase the strength of the connection between shell 44 and brickmold 100. Because shell 44 is resilient and somewhat flexible, male portion 98 may be inserted within receiver 96 before or after the fing member is installed within a wall. Attachment of brickmold 100 prior to installation of the frame is even easier, because the lower portion of shell 44, namely the region including and adjacent spacer 102 is free to deform away from core 42 as portion 98 is inserted within receiver 96. Preferably, portion 98 extends along the entire length of brickmold 100, although portion 98 may be a series of spaced-apart units mounted along the length of body portion 104. A continuous extent of portion 98 is preferred, however, because it provides a stronger attachment between shell 44 and brickmold 100 and does not leave gaps in which brickmold 100 may extend slightly away from shell 44.

Brickmold 100 may be formed from a variety of materials, including the previously described cellulosic materials, metal, as well as a variety of molded or extruded materials, such as a vinyl-based or composite material. The body portion may be formed entirely from one of the materials described above, or alternatively may be formed from a shell that is either hollow or filled with a foamed material.

Figure 8:
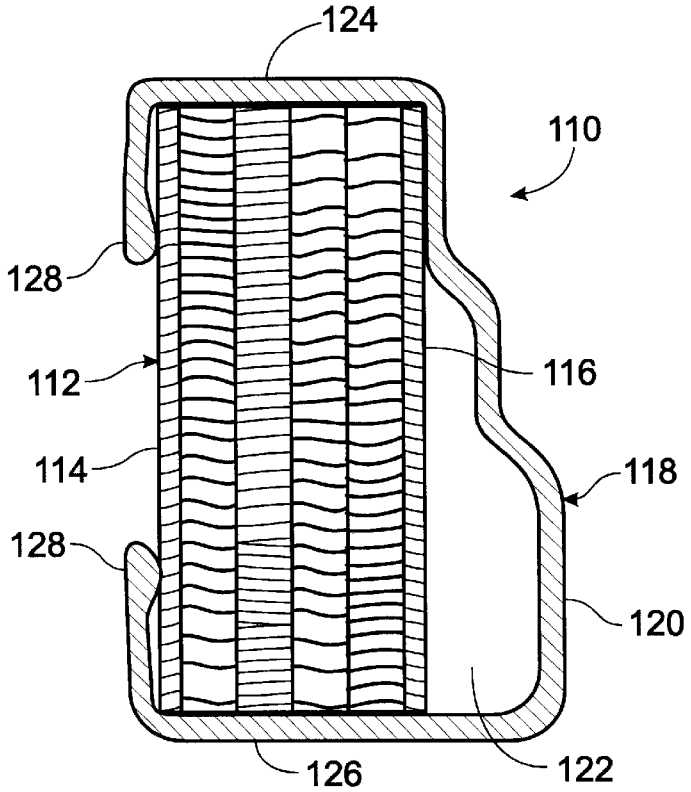
FIG. 8 is a cross-sectional view of another embodiment of the invented brickmold.

In FIG. 8, an alternate embodiment of brickmold 100 is shown and indicated generally at 110. Using the shell and core concept described above with respect to the framing members, brickmold 100 is more durable, offers greater flexibility in design and retains its shape and appearance longer than conventional brickmold. Furthermore, it is significantly faster and easier to assemble, offering virtually limitless ornamental features without requiring the waste, time and labor of conventional brickmold.

It should be understood that conventional brickmold, like a conventional door frame, is typically formed of lumber, which is shaped in an analogous method as described above with respect to a conventional door frame. Because most users prefer brickmold that adds to the aesthetic appearance and style of their house, office, etc., conventional brickmold must be molded, routed, or otherwise wood-worked to attain the desired appearance. The time and labor involved to give brickmold this appearance significantly increases the cost of the brickmold, as well as the time and labor to manufacture it.

Brickmold 110 includes a core 112, which as shown is preferably constructed of plywood. Similar to core 42 of the members, core 112 may be constructed from any of the previously described cellulosic, composite and foamed materials, as long as they are capable of receiving and retaining screws or other fasteners inserted therein and used to hang a screen or storm door on the brickmold. Therefore, brickmold 110 must have a similar structural integrity as the frame's core so that it can withstand and support the weight of the door and the forces imparted as the door is used. Core 112 includes a frame surface 114, which is oriented toward frame 30 when brickmold 110 is mounted on the frame, and an exterior surface 116, which faces away from the frame when brickmold 110 is mounted thereon.

Shell 118 is mounted on core 112 and is at least substantially coextensive with the core. Shell 118 is preferably waterproof and formed from one of the previously recited materials of construction for shell 44. Shell 118 provides a durable cover for core 112 that protects the core from the environment, as well as from physical damage. Shell 118 includes a raised portion 120 that extends away from exterior surface 116 of core 112 to define a cavity or pocket between shell 118 and exterior surface 116. Because raised portion 120 is formed during the extrusion, roll forming or other process used to form shell 118, it can very easily and effortlessly be shaped to have an elaborate, ornate configuration which would require considerable time and effort to achieve from lumber. Additionally, because shell 118 is a structal member that is capable of retaining its shape even when not mounted on core 112, shell 118 does not require the underlying core to support raised portion 120 to maintain its shape and appearance. Instead, shell 118 protects core 112, helping it retain its shape, appearance and integrity over time and exposure to the elements. As shown in FIG. 8, raised portion 120 has a tiered appearance, with a pair of steps or tiers extending outwardly from exterior surface 116. It should be understood that raised portion 120 may have an almost endless number of curved, tiered, notched, or otherwise shaped surfaces, all of which may be formed with precision and uniformity as shell 118 is formed. It is within the scope of the invention that the cavity may be filled with a suitable filler material, such as disclosed herein, and/or that the shell may include at least one supporting rib extending within the cavity.

Shell 118 includes a pair of lateral edges 124 and 126 that extend toward frame surface 114 of core 112, each of which terminates in a foot 128 that is preferably biased to retain shell 118 on core 112. Similar to the above-recited framing members, shell 118 preferably may be snap-fit onto core 112, and as such retained on the core without requiring additional fasteners or an adhesive. It may be preferable, however, to coat the core or shell with an adhesive prior to snap-fitting the members together to increase the bond between the members. Brickmold 110 is attached to an exterior door frame, such as frame 30, with a suitable fastener, such as nails.

Figure 9:
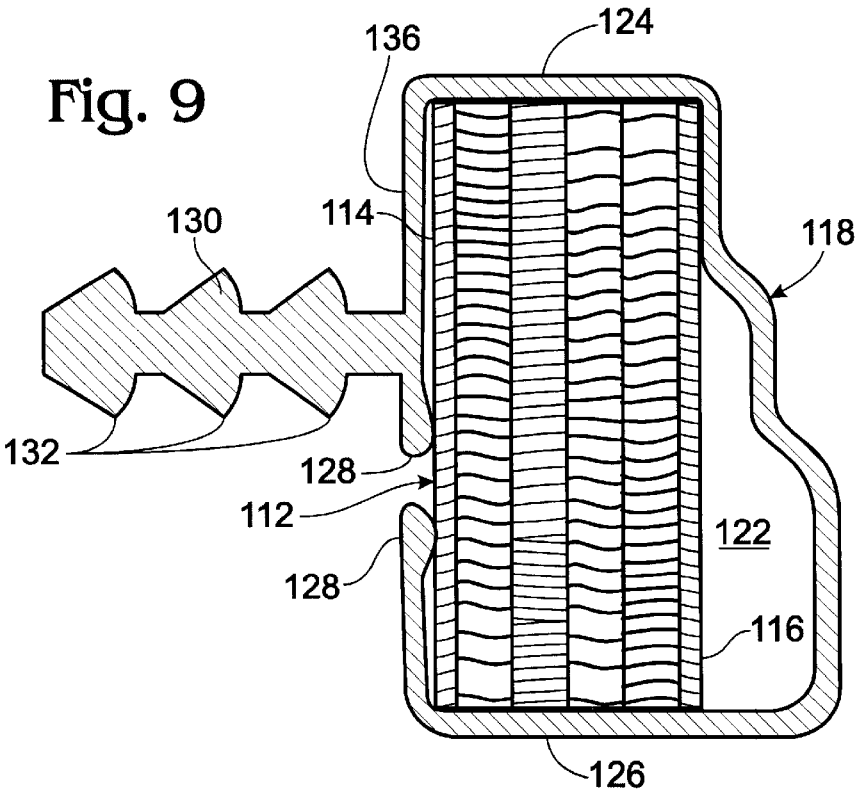
FIG. 9 is a cross-sectional view of another embodiment of the invented brickmold.

In FIG. 9, an alternate embodiment of brickmold 110 is shown. This embodiment is virtually the same as the embodiment shown in FIG. 8, except shell 118 includes a prong-like member or male portion 130, which preferably includes a plurality of projections 132 and is adapted to be coupled to a receiver on the frame, as previously discussed with respect to the framing member and brickmold shown in FIG. 7. As shown, one of the shell's lateral members 114 includes a spacer 136 that extends at least partially across frame surface 114 of the core. Portion 130 is mounted on spacer 136, and is preferably integrally formed with the rest of shell 118 to provide a one-piece member. Similarly, portion 130 preferably extends continuously along the length of shell 118, although it is meant to be within the scope of the present invention that shell 118 may include a plurality of discrete portions 130 spaced along the length thereof.

Figure 12:
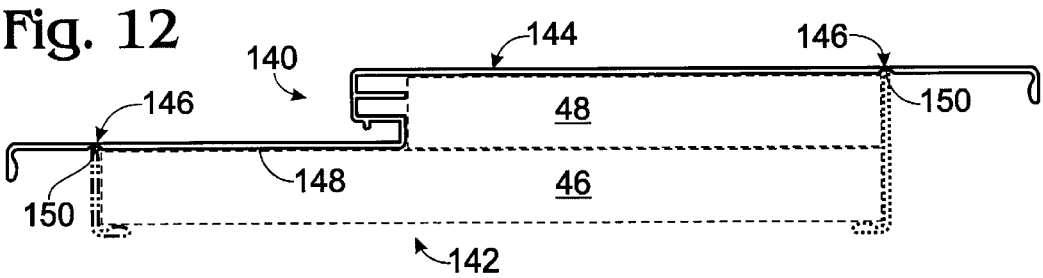
FIG. 12 is a cross-sectional view of another embodiment of a frame member constructed according to the present invention.

Another embodiment of the invented frame member is shown in FIG. 12 and generally indicated at 140. Similar to the previously discussed frame members, member 140 includes a core 142, such as formed from any of the previously discussed base and stop members 46 and 48. Member 140 also includes a shell 144, which once attached to the base member functions and resembles any of the previously described shells 44. However, as shown in FIG. 12, shell 144 includes one or more hinge regions 146 that are adapted to be selectively bent from the position shown in solid lines in FIG. 12 to the position shown in dashed lines. Regions 146 may also be referred to as regions of reduced thickness. For example, in the illustrated embodiment, the inner edge 148 of the shell includes a depression 150 at each region 146 to facilitate the bending of the shell at region 146. Depressions 150 may extend along the entire length of shell 144. Alternatively, depressions 150 may extend only partially along the length of the shell, or in spaced-apart intervals along at least a portion of the length of the shell.

An advantage of a shell with hinge regions 146 is that adhesive may be applied to more of the shell in a single pass, such as by roll coating. For example, in FIG. 12 almost the entire horizontal portion of the shell's inner edge 148 may be coated in a single pass. Once the adhesive is applied, the shell may be wrapped around the core, typically under compression during the wrapping stage until the adhesive cures. It should be understood that any of the embodiments of the shell disclosed herein may be implemented with one or more hinge regions 146, and the specific embodiment shown in FIG. 12 is for the purpose of illustration.

Figure 13:
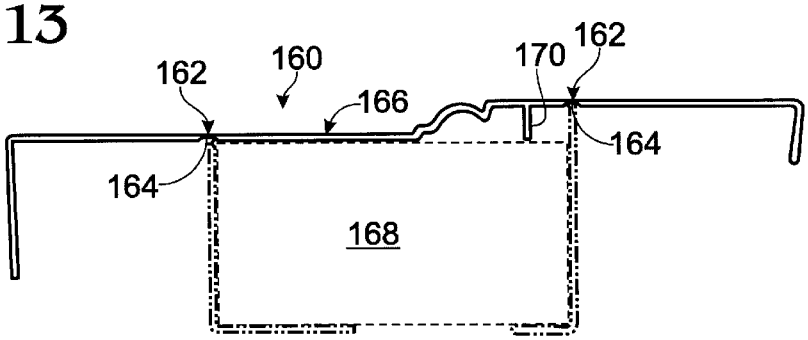
FIG. 13 is a cross-sectional view of another embodiment of a brickmold member constructed according to the present invention.

For example, in Fig, 13 an embodiment of the invented brickmold is shown at 160 and includes a pair of hinge regions 162 with corresponding removed regions, or depressions, 164, in a shell 166. Similar to the hinge regions of frame member 140, hinge regions 162 enable a greater amount of the shell to be covered with adhesive (not shown) in a single pass before the shell is wrapped around a core 168, which may be formed from any of the previously described core materials. Also shown in FIG. 13 is a rib 170 used to reinforce the shell of brickmold 160. It is within the scope of the present invention that one or more such ribs may be used.

As discussed, frame 30 may be constructed with significantly less time, labor and waste than conventional frames. The framing members of frame 30 are generally constructed in separate segments, namely, segments with lengths that correspond to the length of the jambs and header of the door to be hung (and cavity to be filled). Because the members have identical cross-sectional configurations, however, it should be understood that longer lengths could be formed and then subsequently cut to the desired length. Nonetheless, the below-described process is applicable to either method. As will soon become evident, the invented method enables an exterior door frame of superior quality, durability and strength to be constructed with dramatically less time and effort than conventional frames.

To form core 42, sheets of plywood or one of the other suitable sheet-like materials are obtained with the desired thickness of base member 46 and stop member 48. As an illustrative, but not limiting example, base member 46 may be approximately 0.75 inches thick, while stop member 48 may be approximately 0.50 inches thick. Next, the sheets of material are cut into strips corresponding generally to the distance between the outside and inside surfaces of the wall in which the frame is to be installed. As discussed previously, this width will vary depending on the materials used to build the house or other building, but are generally of standardized dimensions. When the embodiment of the core shown in FIG. 7 is to be manufactured, it should be understood that the width of the strips for base member 46 will be appropriately less than the distance between the wall's surfaces to leave room for receiver 96.

Next, the strips are cut to the desired length for the framing member to be built. The strip that will form the stop member is notched at both ends, as shown in FIG. 2. In FIG. 2, only the jamb members are notched, however, it is within the scope of the present invention that both the jamb members and the header may be notched. As shown, one end of each jamb's stop member 48 is removed, or square cut, so that header 36 can lie flush against that portion of the jamb. An alternate way of notching the upper end of the jambs is to remove smaller portions of the stop members on the corresponding ends of the header and the jambs to provide multiple contact and support surfaces between jambs 30 and 32 and header 36. Similarly, a portion of the stop member at the other end of each jamb is often removed to enable the ends of sill 38 to lie flush against the jambs. As discussed, the shape and angle of sill 38 may vary, depending on the type of structure being built and the user's preferences. It should be understood that the lower portion of the jambs may be notched or cut accordingly to provide a mounting surface for the sill.

After notching the strip that will form the stop member, the strips are secured together so that one pair of lateral edges, namely the edges that will become outside edges 58 and 60, are aligned and coplanar. If the embodiment shown in FIG. 7 is to be built, then the edges are offset by a determined distance equal to the depth of receiver 96. When joining the strips to form core 42, the notched strip should be positioned on the base member strip so that the notched portions are a defined distance away from each end of the base member. Specifically, the stop member strip is notched to provide a removed region adjacent each end of the formed framing member. Therefore, when the strips are joined, they should be positioned to maintain the dimensions of these removed regions.

Shell 44 is formed into the one of the previously described configurations through a suitable molding process. Extrusion and roll-forming have proven to be particularly effective methods of forming shell 44, with extrusion being the presently preferred method. Because shell 44 is formed from what initially is a relatively amorphous material, it may be dyed or tinted to a desired color, such as a white or cream color, prior to being used to form the shell. After forming a length of shell 44 in one of the previously described configurations, the shell is cut to a desired length, if necessary, and notched in a similar fashion as the core to which it will be attached. Next, the core and shell are joined, preferably by snap-fitting the shell on the core. To provide a more secure bond between the core and the shell, an adhesive may be applied to the core, shell, or both prior to uniting the members. If shell 44 does not include integrally formed weather stripping, previously shown in FIG. 6, then weather stripping should be inserted within channel 84.

It should be understood that the core and shell may be notched prior to assembly, or may be notched at the same time after the framing member is formed by sending the entire framing member through a double end tenoner. If this method of notching the framing members is to be used, the members should be formed initially slightly longer than needed for the finished member. For example, a standard eight-one and one-half inch jamb member should be initially cut to eighty-two inches in length. After sending the eighty-two inch member through the double end tenoner, it will have the desired, notched, eighty-one and one-half inch length. This method is currently preferred because it provides for even further reductions in manufacturing time and labor because the base member, stop member and shell are joined when they are all the same length, and then subsequently notched in a single step.

Finally, the framing members are joined together to form the exterior door frame shown in FIG. 2, a door is hung on the door-side jamb, and sockets are formed within the lock-side jamb. If brickmold is to be attached to the frame, it may be attached either prior to assembly of the frame, or after the framing members have been joined.

While the present invention has been shown and described with reference to the foregoing preferred embodiment, it is to be understood by those of skill in the art that other changes in form and detail may be made therein without departing from the spirit and scope of the invention as defined in the following claims. For example, while the invention has been described as an exterior door frame, it should be understood that it may be used indoors as well, especially in a building or other structure with internal entryways, such as an apartment complex or office building.

I claim:

1. A composite door frame member, comprising:

a core including an elongate base member with a wall side, a door side and spaced-apart inside and outside edges extending between the wall side and the door side, the core further including an elongate stop member connected to the door side of the base member, the stop member including an inside edge extending transversely away from the door side, and the inside edge of the stop member and adjacent region of the door side of the base member distal the stop member forming a door-receiving notch therebetween;

a shell disposed over the core to substantially cover and conform to the door side of the base member and the stop member, the shell further including a shelf projecting away from the inside edge of the stop member into the door-receiving notch to form a stop edge adapted to selectively engage and stop the movement of a door, and to define a cavity between the shelf and the inside edge of the stop member, wherein the cavity extends along at least a substantial portion of the length of the inside edge of the stop member; and a filler received within and at least partially filling the cavity.

2. The frame member of claim 1, wherein the filler is formed from an extrudable material.

3. The frame member of claim 1, wherein the filler is formed from a foamed material.

4. The frame member of claim 1, wherein the filler is formed from an injectable material.

5. The frame member of claim 1, wherein the filler is integrally formed with the shell.

6. The frame member of claim 1, wherein the filler is formed from the same material as the shell.

7. The frame member of claim 1, wherein the shell is seamless.

8. The frame member of claim 1, wherein the shell is snap-fit on the core.

9. The frame member of claim 1, wherein the shell is a one-piece waterproof shell.

10. The frame member of claim 1, wherein the shelf includes at least one rib extending within the cavity to engage the inside edge of the stop member and thereby reinforce the shelf against forces imparted to the stop edge.

11. The frame member of claim 1, wherein the shell includes a channel between the shelf and the door side of the base member, the channel being adapted to receive and retain weather stripping.

12. The frame member of claim 1, wherein the shell includes at least one tooth extending into the channel from the shelf to retain weather stripping within the channel.

13. The frame member of claim 1, wherein the shell is a one-piece unit that includes integrally formed weather stripping.

14. The frame member of claim 1, wherein the core is constructed from a cellulosic material.

15. The frame member of claim 1, wherein the core is formed from plywood.

16. The frame member of claim 15, wherein the shell includes a receiver adapted to receive and support brickmold.

17. The frame member of claim 16, wherein the frame includes brickmold having a body member and a projecting member extending from the body member to be received and retained within the receiver on the shell.

18. The frame member of claim 1, wherein the core is constructed from a foamed material.

19. The frame member of claim 1, wherein the shell is adhesively secured on the core.

20. The frame member of claim 1, wherein the shell includes a brickmold-receiving notch bounded by the outside edge of the base member and a portion of the wall side of the stop member which is not in direct contact with the door side of the base member.

21. The frame member of claim 20, wherein the shell includes a receiver for securing and supporting brickmold, and further wherein the receiver is at least substantially disposed within the brickmold receiving notch.

22. The frame member of claim 21, further including brickmold having a body member and a projecting member extending from the body member to be received and retained within the receiver on the shell.

23. A brickmold member, comprising:

a core having top and bottom surfaces and inside and outside edges; and a shell extending over at least the top surface and the inside and outside edges of the core, wherein the shell includes a profiled region that extends at least partially away from the top surface of the ore to define a cavity therebetween, and further wherein the cavity is at least partially filled with a filler.

24. The brickmold member of claim 23, wherein the shell is adapted to cover at least a portion of the bottom surface of the core, and further wherein the shell is snap-fit on the core.

25. The brickmold member of claim 23, wherein the core is formed from a cellulosic material.

26. The brickmold member of claim 23, wherein the core is formed from a foamed material.

27. The brickmold member of claim 23, wherein the shell further includes a projecting member extending generally away from the core and adapted to be received within a corresponding receiver.

28. The brickmold member of claim 23, wherein the shell includes at least one rib extending within the cavity.

29. A door frame assembly, comprising:

a door frame comprising a pair of elongate, spaced-apart jambs having upper portions and a header extending between the upper portions of the jambs, wherein the door frame includes an edge; and a brickmold member comprising a core having top and bottom surfaces and inside and outside edges, and a shell extending over at least the top surface and the inside and outside edges of the core, wherein the shell includes a profiled region that extends at least partially away from the top surface of the core to define a cavity therebetween, and further wherein the brickmold extends along at least a portion of the edge of the door frame.

30. The door frame assembly of claim 29, wherein the bottom surface of the brickmold member is mounted on the edge of the door frame.

31. The door frame assembly of claim 29, wherein the shell includes at least one rib extending within the cavity.

32. The door frame assembly of claim 29, wherein the cavity is at least partially filled with a filler.

33. The door frame assembly of claim 29, wherein the core is formed from a foamed material.

34. The door frame assembly of claim 29, wherein the core is formed from a cellulosic material.

* * * * *